US009289778B2

(12) United States Patent
Browne et al.

(10) Patent No.: US 9,289,778 B2
(45) Date of Patent: Mar. 22, 2016

(54) MAGNETIC SEPARATOR SYSTEM AND METHOD USING SPATIALLY MODULATED MAGNETIC FIELDS

(75) Inventors: Alan L. Browne, Grosse Pointe, MI (US); Jan F. Herbst, Grosse Pointe Woods, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 13/356,860

(22) Filed: Jan. 24, 2012

(65) Prior Publication Data

US 2013/0186807 A1 Jul. 25, 2013

(51) Int. Cl.
*B03C 1/20* (2006.01)
*B03C 1/22* (2006.01)

(52) U.S. Cl.
CPC ... *B03C 1/20* (2013.01); *B03C 1/22* (2013.01); *B03C 2201/20* (2013.01)

(58) Field of Classification Search
CPC ..... B03C 1/16; B03C 1/22; B03C 2201/20; B03C 2201/22; B03C 1/12; B03C 1/14; B03C 1/06; B03C 1/08; B03C 1/18; B03C 1/20
USPC ..... 209/218, 219, 221, 223.2, 224, 209/225–231
See application file for complete search history.

(56) References Cited

U.S. PATENT DOCUMENTS

| | | | | |
|---|---|---|---|---|
| 1,380,871 | A * | 6/1921 | Swart | 209/223.2 |
| 1,712,808 | A * | 5/1929 | Bing | 209/219 |
| 3,042,205 | A * | 7/1962 | Merwin | 209/218 |
| 4,781,821 | A * | 11/1988 | Salmi | 209/214 |
| 5,626,233 | A * | 5/1997 | Wells, II | 209/219 |
| 6,068,133 | A * | 5/2000 | Schonfeld et al. | 209/219 |
| 7,210,581 | B2 * | 5/2007 | Robinson et al. | 209/221 |
| 7,367,457 | B2 * | 5/2008 | Warlitz et al. | 209/225 |
| 7,927,489 | B2 * | 4/2011 | Tashiro | 210/222 |
| 8,638,186 | B1 * | 1/2014 | LaPoint | 335/306 |
| 9,144,828 | B2 * | 9/2015 | Shuttleworth | B07C 5/04 |
| 2007/0221542 | A1 * | 9/2007 | Molteni | 209/212 |
| 2013/0240413 | A1 * | 9/2013 | Keaton et al. | 209/3.1 |

FOREIGN PATENT DOCUMENTS

WO WO 2014061256 A1 * 4/2014 ..... B03C 1/18

* cited by examiner

*Primary Examiner* — Jeremy R Severson
(74) *Attorney, Agent, or Firm* — Mark S. Cohen; Pearl Cohen; Zedek Latzer Baratz LLP

(57) ABSTRACT

A magnetic separator system may include a rotating wheel, a conveyor belt drawn around the wheel, and at least one magnetic array. The pulley transports material mix through a spatially modulated magnetic field generated by the magnetic array. The magnetic array may be fixed in place on the pulley and directed towards the stream of material mix, or multiple magnetic arrays may be distributed on the conveyor belt or wheel of the pulley.

2 Claims, 6 Drawing Sheets

MAGNETIC SEPARATOR SYSTEM AND METHOD USING SPATIALLY MODULATED MAGNETIC FIELDS

FIELD OF THE INVENTION

The present invention is related to magnetic separator systems, and to separating magnetic particles from materials in different patterns.

BACKGROUND

Magnetic separator systems separate metallic material from a slurry or a mixture of metallic and nonmetallic material. Mixtures may pass through a magnetic field or a group of magnets, which attracts the magnetic material and separates the magnetic material from the mixture. A scraping or removal mechanism may follow the separation, removing the magnetic material that experiences an attracting force to the magnets. Magnetic separator systems may have a diverse array of applications, for example removing ferrous metal contaminants from dry particulate, liquids, and slurries in the processing of grain, feed, sugar, cereal, chemical, mineral, plastics, oil, textile, salt, pharmaceuticals, and recycled products, among other kinds of mixtures.

SUMMARY

A magnetic separator system may include a pulley that includes a wheel, a conveyor belt drawn around the wheel, and at least one magnetic array. The pulley transports material mix through a spatially modulated magnetic field generated by the magnetic array. The magnetic array may be fixed in place on the pulley and directed towards the stream of material mix, multiple magnetic arrays may be distributed on the conveyor belt or wheel of the pulley, or other arrangements may be used.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
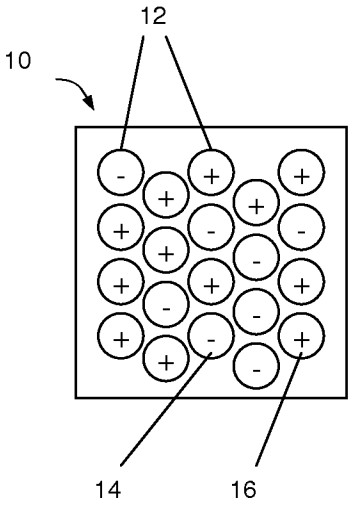
FIG. 1 is a diagram of a magnetic array and spatially modulated magnetic field according to one embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following detailed description, numerous specific details are set forth in order to provide a thorough understanding of the invention. It will however be understood by those skilled in the art that the present invention may be practiced without these specific details. In other instances, well-known methods, procedures, and components have not been described in detail so as not to obscure the present invention.

A magnetic separator may include a pulley that includes a rotating wheel or cylinder and a conveyor belt drawn around or disposed (e.g., at least partially on) the rotating wheel. The rotating wheel or cylinder may be powered by a motor and supported by a support arm. As the rotating wheel spins, friction between the conveyor belt and rotating wheel may allow the conveyor belt to move forward and transport a stream of material mix that includes magnetic and non-magnetic particles. The magnetic particles may be ferrous or metallic. As the material mix or feed is transported by the conveyor belt towards a drop-off endpoint, one or more magnetic arrays on the pulley may attract some or all of the magnetic particles away from the material mix, while the rest of the material mix may fall onto an output conveyor system that transports filtered material. Depending on the configuration and placement of the magnetic arrays, the magnetic separation system may output filtered material that has varying concentrations of magnetic particles in a spatial distribution or format. The magnetic arrays, for example, may be fixed or set onto a fixed wheel on the support arm and directed towards the material mix passing in its vicinity. The spatially modulated magnetic field emitted by the magnetic array may attract some or all of the magnetic particles in the stream of material mix. A magnetic array emitting a stronger spatially modulated magnetic field may attract more magnetic particles than a magnetic array emitting a weaker one.

The magnetic arrays may also be arranged in a pattern or configuration on a fixed wheel, rotating wheel, or conveyor belt. As the stream of material mix is transported by the conveyor belt, the configuration of magnetic arrays may create a time-varying magnetic filter, since different magnetic arrays may attract different amounts of magnetic particles at different times. The near-field strength of the magnetic arrays may allow a magnetic separator to be designed with less magnetic material when the magnetic arrays are fixed, or designed with specific magnetic patterns when a spatially-varied distribution of magnetic material is desired. The focused, near-field strength of the magnetic arrays may decrease the magnetic interference between magnetic arrays that are in close proximity to each other. In some embodiments this may allow detailed patterns and designs to be created.

When used herein, magnetism and magnetic field may be interchangeable terms that describe the magnetic moment, or force, that an object or region exerts on another object or region. While magnetism may particularly describe the way that an object's subatomic particles are aligned, an object's magnetism may also describe the magnetic field emitted by the object. A magnetic field may be described by a vector field describing magnetic moment, and may include a direction and a magnitude (e.g., an intensity or strength). Magnetic field vectors or field lines may be emitted from a magnetic pole (e.g., magnetic dipoles). Regions of a material or object may be or may include magnetic moments. Magnetic moments may, for example, be positively and/or negatively magnetized regions (e.g., emitting magnetic fields) of varying magnitude or strength.

Magnetic fields may, for example, be generated using electromagnets, permanent magnets, ferromagnetic metals, spatially modulated magnetic field based devices, or other components or devices. A magnetic field may be spatially modulated, in that multiple adjacent magnetic fields (positive or negative) from an arrangement or array of magnetic sources create a close field of different magnetic polarizations and intensities. Spatially modulated magnetic fields may, for example, be created from an array of magnetic or electric field emission sources or magnetized regions in a material (e.g., a ferromagnetic metal). A magnet may, for example, be material or an object that emits or produces a magnetic field, which may be a vector field including a direction and a magnitude (e.g., an intensity or strength). A material (e.g., a ferromagnetic material, metal, or other type of material), object, or regions of a material or object may, for example, be positively, negatively, or neutrally magnetized. Spatially modulated magnet fields may, for example, include a unique arrangement, combination or array of positively and negatively magnetized regions in a material. Such an array may be arranged horizontally on a flat object, flat portion of an object, a surface or other portion (such as a curved surface or an interior portion) of an object, or a plane. Each of multiple magnetized regions (e.g., magnetic regions, maxels, or other regions) may, for example, be a positively or negatively polarized magnetic field emission source of a pre-determined intensity. A magnetic region may be a region of varying size, surface area (e.g., 1 micron (μm) or greater in diameter), or volume. Multiple positive or negative magnetically charged regions may be arranged in an array or pattern on or in a material. An array or pattern of magnetized regions may, for example, create a unique magnetic pattern, fingerprint or signature. The array of magnetized regions may, for example, be pre-selected, programmed, or determined to have desirable properties (e.g., with other materials or objects with an array of magnetic regions or other magnetic materials).

A magnetic array may, for example, generate higher near-field magnetic flux than a typical magnet due to the fact that positively magnetized regions (e.g., positive poles) are located next to or in close proximity to negatively magnetized regions (e.g., negative poles). The close proximity of positively charged regions and negatively charged regions may result in reduced far-field magnetic flux and increase near-field magnetic flux because a shortest path or path of least resistance between oppositely polarized magnetized poles may be reduced. As a result of greater near-field magnetic flux, magnetic force (e.g., attractive or repulsive magnetic force) between one magnetic array and another ferromagnetic object, may be concentrated in the near-field and drop dramatically with distance. Using magnetic arrays may reduce the effects of far-field magnetism acting on other magnetic components within a device and may isolate their effect on other magnetic materials within a small region. Magnetic separation devices may be able to use the near-field effects of magnetic arrays to create magnetic filters that attract magnetic particles in specific areas on a material.

A magnetic array may include any suitable configuration, arrangement, or grouping of positively and negatively magnetized regions. The magnetic array may, for example, include adjacent positively magnetized regions and negatively magnetized regions. The magnetic array may be configured in a way that generates a higher near-field magnetic flux, or, in another example, directs the magnetic field towards a ferromagnetic object. An array or pattern of magnetized regions may, for example, create a unique or relatively unique magnetic pattern, fingerprint or signature. The array of magnetized regions may, for example, be pre-selected, programmed, or determined to have desirable properties (e.g., with other materials or objects with an array of magnetic regions or other magnetic materials).

FIG. 1 is a diagram of a magnetic array according to embodiments of the present invention. Referring to FIG. 1, in some embodiments, a magnetic array 10 made of magnetic materials or components may generate a spatially modulated magnetic field. Spatially modulated magnetic field may, for example, be generated by an array 10 of magnetic or electric field emission sources or magnetized regions 12 in a material (e.g., a ferromagnetic metal, or a ring). A magnetic array 10 may, for example, include an arrangement and/or combination of magnetized regions 12 (e.g., maxels, magnetic dipole regions, or other regions). Magnetized regions 12 may include positively magnetized regions 16, negatively magnetized regions 14, or other types of magnetized regions. Each of multiple magnetized regions 12 may, for example, be a positively polarized magnetic field emission source 16 or negatively polarized magnetic field emission source 14 of pre-determined magnitude (e.g., magnitude, strength, or intensity of magnetic field). A magnetic region 12 may be a region of any suitable size, surface area (e.g., 1 micron (μm) or greater in diameter, or other dimensions), shape, or volume. Multiple positively magnetized regions 16 and negative magnetized regions 14 may be arranged in an array or pattern on a material (e.g., generating a spatially modulated magnetic field). Positively magnetized regions 16 and negative magnetized regions 14 may, for example, be arranged in a grid, staggered grid, predetermined pattern (e.g., a spiral or other pattern), random pattern, or any other spatial arrangement. A magnetic array 10 may, for example, generate a unique magnetic field (e.g., a magnetic fingerprint or signature).

Spatially modulated magnetic fields generated by magnetic arrays 10 on two or more materials or objects may be defined or pre-determined such that the two magnetic fields and thus the materials may complement one another. Spatially modulated magnetic fields generated by magnetic arrays 10 on two or more materials may, for example, complement one another by generating an attractive, repulsive, or neutral magnetic force between the two materials. The strength or magnitude of the magnetic force between two magnetic arrays 10 may be a function of a distance between two materials and/or other parameters. The strength or magnitude of the magnetic force between a magnetic array 10 generating a spatially modulated magnetic field and another ferromagnetic material may be a function of a distance between the two materials and/or other parameters.

Figure 2:
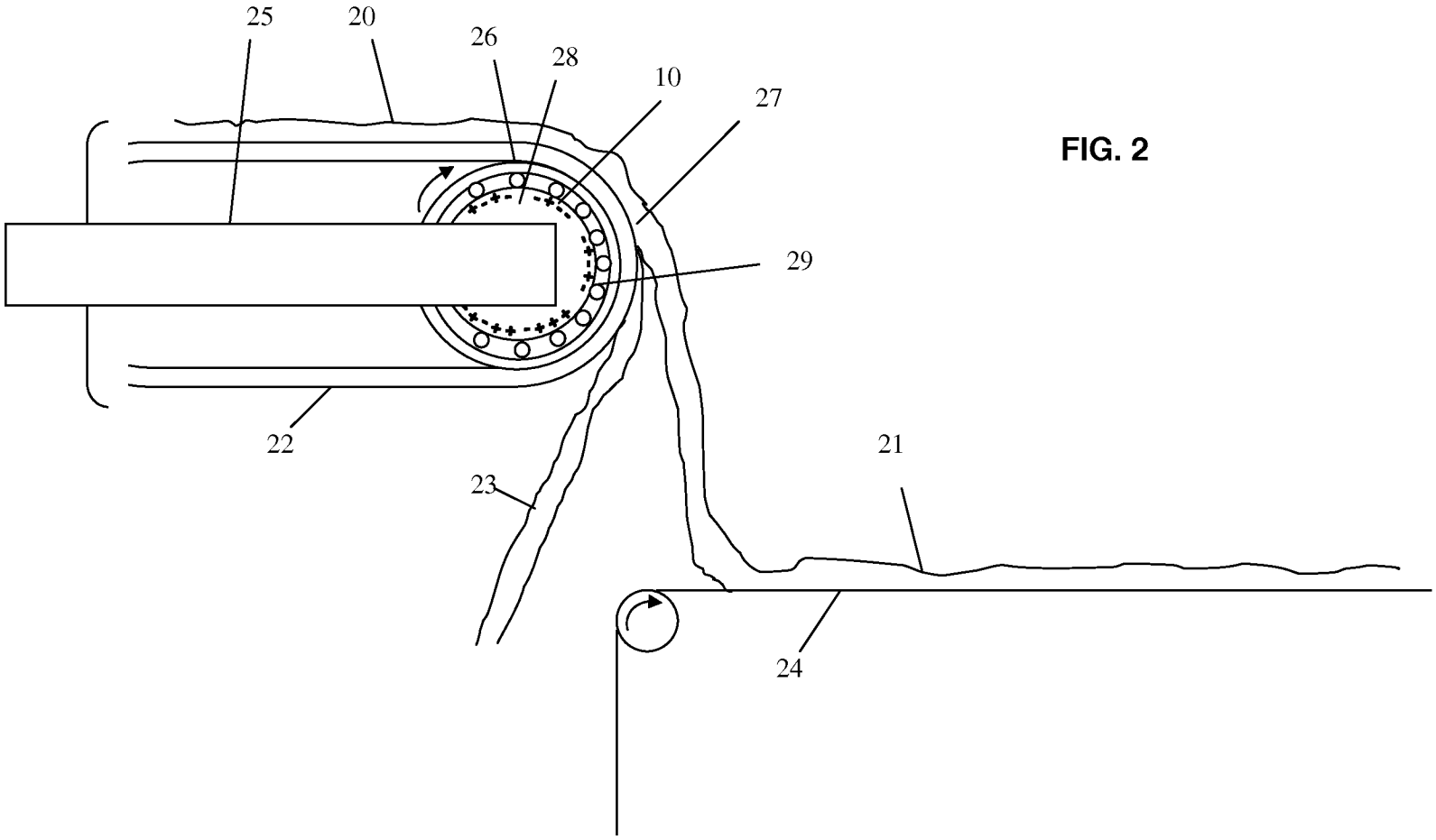
FIG. 2 is a diagram of a magnetic separator with fixed magnetic arrays according to one embodiment of the present invention.

FIG. 2 is a diagram of a magnetic separator system with fixed magnetic arrays 10, according to an embodiment of the present invention. A magnetic separator system may include a pulley 3 that includes a rotating wheel 26 with a conveyor belt 22 drawn around, powered by, or otherwise disposed, at least partially on, rotating wheel 26. Conveyor belt 22 may be made of any suitable unmagnetized material and may have a flexible configuration so that it can be easily drawn around a rotating wheel 26 of the pulley 3. For example, conveyor belt 22 may be rubberized, plastic, canvas or other fabric, or any series of unmagnetized metal links or grates that would form a belt or band-like shape. Other kinds of belts may be used. Rotating wheel 26 may assist the conveyor belt 22 in transporting a stream of material mix 20 through a magnetic filter, e.g., through a spatially modulated magnetic field, towards a drop-off point 27. Near the drop-off point 27, one or more fixed magnetic arrays 10 may attract magnetic particles 23 contained within material mix 20 away from the material mix 20. The rest of the material mix 20 may fall into an output system 24 that receives a stream of filtered material mix 21. The output system 24 may be a conveyor system, a receptacle, or other device. The magnetic particles 23 separated away from the material mix 20 may then be saved or discarded. In one embodiment, the magnetic arrays 10 may be disposed on or fixed into, for example, a fixed wheel 28 held for example by a support arm 25 or another structure, and the magnetic arrays 10 may be directed towards the stream of material mix 20. The fixed wheel 28 may be surrounded by a cylindrical ball bearing sleeve 29, allowing the rotating wheel 26 to rotate around the fixed wheel 28, and push the conveyor belt 22 forward. The arrangement of magnetic arrays 10 may have the same pattern around the fixed wheel or across the fixed wheel's width, or the pattern may vary across these dimensions. Since the same magnetic arrays 10 are attracting some or all of the magnetic particles 23 away from the stream of material mix 20, the conveyor belt 22 may output uniformly filtered material mix 21. As the stream of material mix 20 passes through the fixed magnetic arrays' 10 spatially modulated magnetic field, magnetic particles 23 in the magnetic arrays' 10 vicinity may be removed from the material mix 21 at a constant rate. This may leave an output of filtered material mix 21 that has a spatially uniform distribution or density of magnetic particles. If the arrangement or pattern of magnetic arrays varies across the width of the fixed wheel 28, the output of filtered material mix 21 may have a spatially varying distribution or pattern of magnetic particles across the width of the conveyor belt 22, with a pattern similar to the pattern of the magnetic arrays 10.

Figure 3:
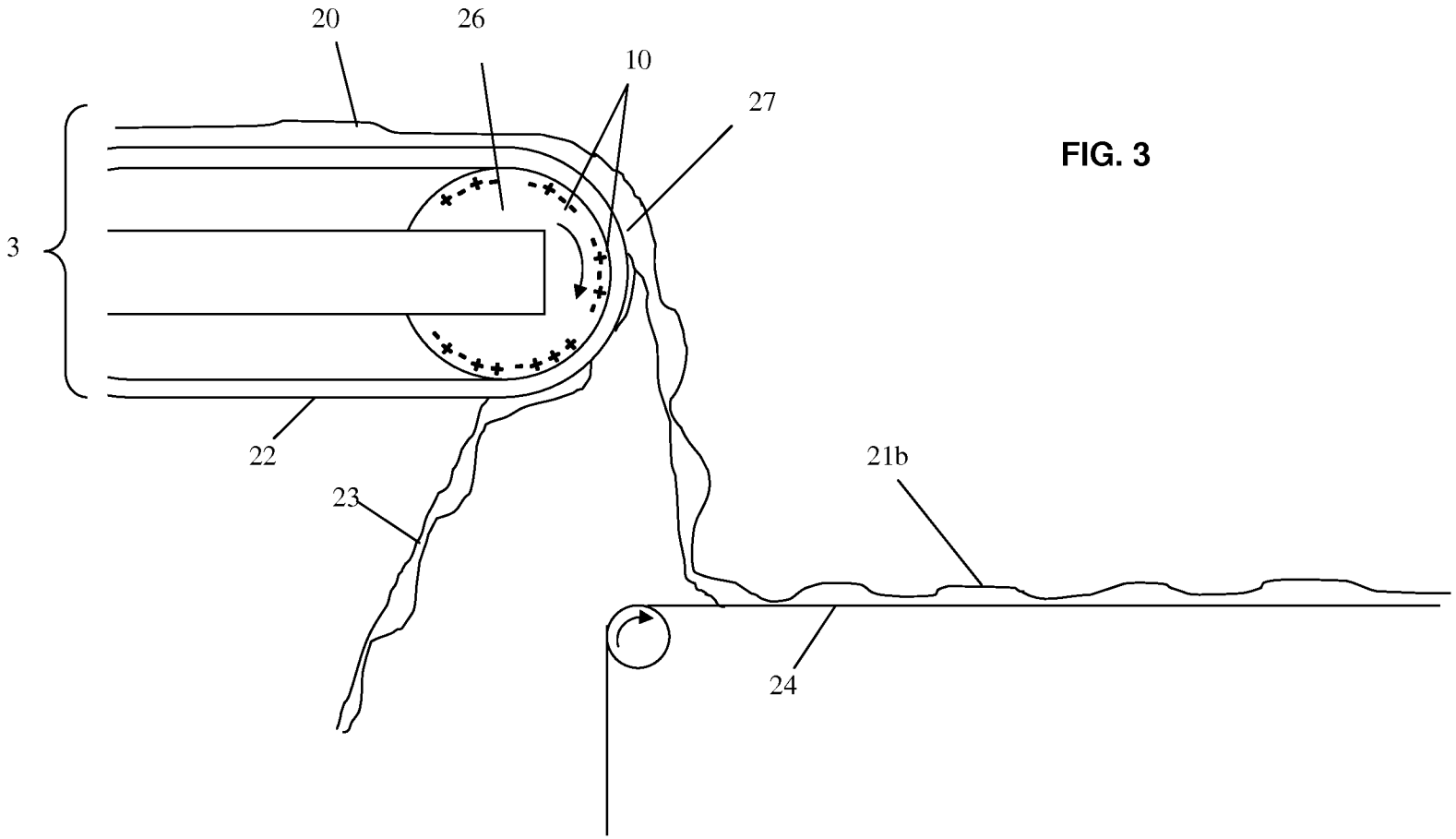
FIG. 3 is a diagram of a magnetic separator with magnetic arrays distributed on the wheel of a pulley according to one embodiment of the present invention.

FIG. 3 is a diagram of a magnetic separator system with magnetic arrays 10 disposed or distributed on or in a rotating wheel or cylinder 26 of a pulley 3, according to an embodiment of the present invention. Pulley 3 may include or have disposed thereon a plurality of magnetic arrays 10 that are arranged around the circumference of rotating wheel 26 or across the surface of the rotating wheel 26 in the axial direction, or both. The magnetic arrays 10 may have similar or different strengths of magnetism, or they may be arranged in a pattern around the rotating wheel 26 or across the rotating wheel's 26 surface. As the rotating wheel 26 rotates to assist the conveyor belt's 22 movement, the magnetic arrays 10 nearest to the material mix 20 may attract magnetic particles 23 away from the material mix 20, while the rest of the material mix falls onto an output conveyor system 24. Since the magnetic arrays 10 may have different magnetic strengths, the rotation of the rotating wheel 26 creates a time-varying magnetic filter applied to the stream of material mix 20. The magnetic arrays 10 closest to the stream 20 may have the greatest effect on the stream's magnetic particles, whereas the arrays 10 on rotating wheel 26 facing away from the stream 20 may have the least effect. The time-varying filter created by the arrangement of magnetic arrays 10 on the rotating wheel 26 may output filtered material 21*b* with varying thickness, as different amounts of magnetic material are removed. In one embodiment, for example, the magnetic arrays 10 may be arranged in a format that resembles a checker board, e.g., rows of alternating sections of magnetism, where each row has a pattern opposite from a neighboring row, or where rows alternate sections having magnetism and sections having no magnetism. For example, areas including magnetic arrays (where within the array, regions of different magnetism may be placed) may alternate with areas including no magnets. In this checkerboard format, or in other embodiments using patterns of magnetized and unmagnetized areas, the magnetic arrays 10 may have a distribution both around the rotating wheel's 26 circumference and perpendicularly across the rotating wheel's 26 width, in an alternating pattern, with unmagnetized areas lacking magnets or magnetic arrays. The material mix 20 that is drawn to the drop-off point 27 may be filtered in a checkered format, and the filtered material 21*b* on the output conveyor system 24 will similarly have a distribution or concentration of magnetic particles that resembles a checker board pattern. Other configurations may be created by different arrangements of the magnetic arrays 10 on the rotating wheel 26. The magnetic arrays 10 may be embedded beneath or on the surface of the rotating wheel 26 and generate a spatially modulated magnetic field beyond the rotating wheel 26 and the conveyor belt 22. These configurations may be different according to desired patterns and desired applications. Magnetic separation may be well-suited to creating or printing wallpaper or other patterns, where material mix 20 containing a mixture of paint and metallic paint is transported by the conveyor belt 22 towards the spatially modulated magnetic field generated by the magnetic arrays disposed on the rotating wheel 26. The spatially modulated magnetic field 8 may produce a checkerboard or other pattern when the metallic paint is separated from the rest of the material mix 20 at the drop-off point 27. Some patterns may also be used for manufacturing tire treads containing metal.

Figure 4:
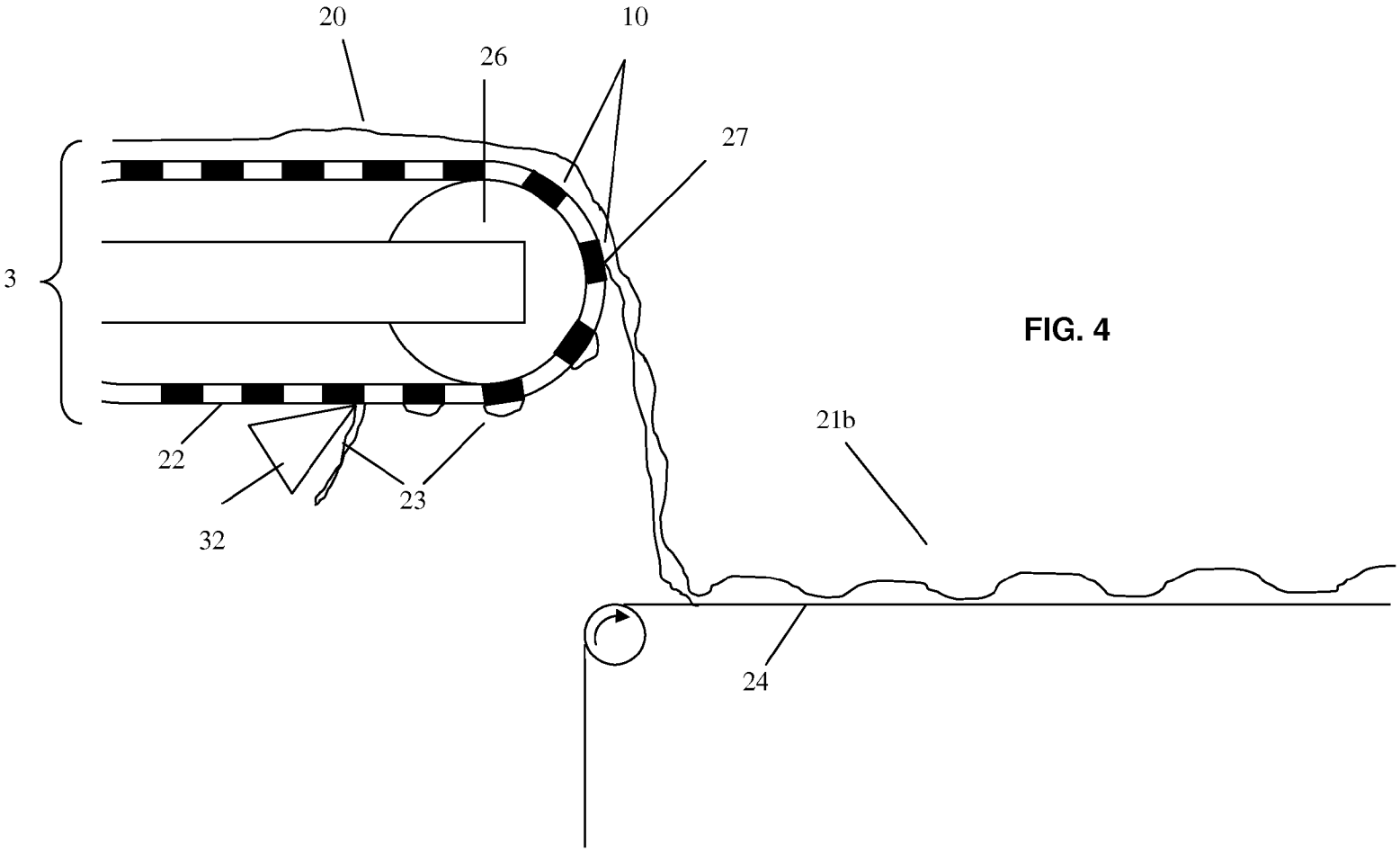
FIG. 4 is a diagram of a magnetic separator with magnetic arrays distributed on the conveyor belt of a pulley according to one embodiment of the present invention.

FIG. 4 is a diagram of a magnetic separator system with magnetic arrays 10 distributed on a conveyor belt 22 of a pulley 3, according to an embodiment of the present invention. Rotating wheel 26 rotates in concert with the movement of the conveyor belt. A plurality of magnetic arrays 10 are distributed along the length of the conveyor belt 22, or perpendicularly along the width of the conveyor belt 22, or both. As material mix 20 is transported by the conveyor belt 22 towards the drop-off point 27, the magnetic arrays 10 may attract magnetic particles 23 that are in the magnetic arrays' 10 near vicinity. At the drop-off point 27, the magnetic particles 23 may continue to stick to the area of the conveyor belt 22 where the magnetic arrays 10 are placed, while the rest of the material mix 20 falls onto an output conveyor system 24. A scraping mechanism 32 may remove the magnetic particles 23 from the conveyor belt 22 after the drop-off point 27. The scraping mechanism 32 may be, for example, a wedge or demagnetizer to reduce the magnetic moment experienced by the magnetic particles 23. The conveyor belt 22 may reuse its pattern of magnetic arrays 10 during each full rotation.

In one embodiment, the magnetic arrays 10 on the conveyor belt 26 may be arranged in a format that resembles a checker board. The material mix 20 that is drawn to the drop-off point 27 may be filtered in a checkered format, and the filtered material 21*b* on the output conveyor system 24 will similarly have a distribution or concentration of magnetic particles that resembles a checker board pattern. Numerous other configurations may be created by different arrangements of the magnetic arrays 10 on the conveyor belt 22, such as a stripe pattern, houndstooth or floral pattern. The magnetic arrays 10 may be distributed, e.g. linearly, along the length of conveyor belt 22 or perpendicularly across the width of the conveyor 22, or both. For example, if a checkerboard pattern is desired, the magnetic arrays 10 may have different magnetic strengths to attract different amounts of magnetic particles 23. The magnetic arrays 10 may be embedded within or on the surface of the conveyor belt 22 and may generate spatially modulated magnetic fields directed towards the material mix 20.

Figure 5:
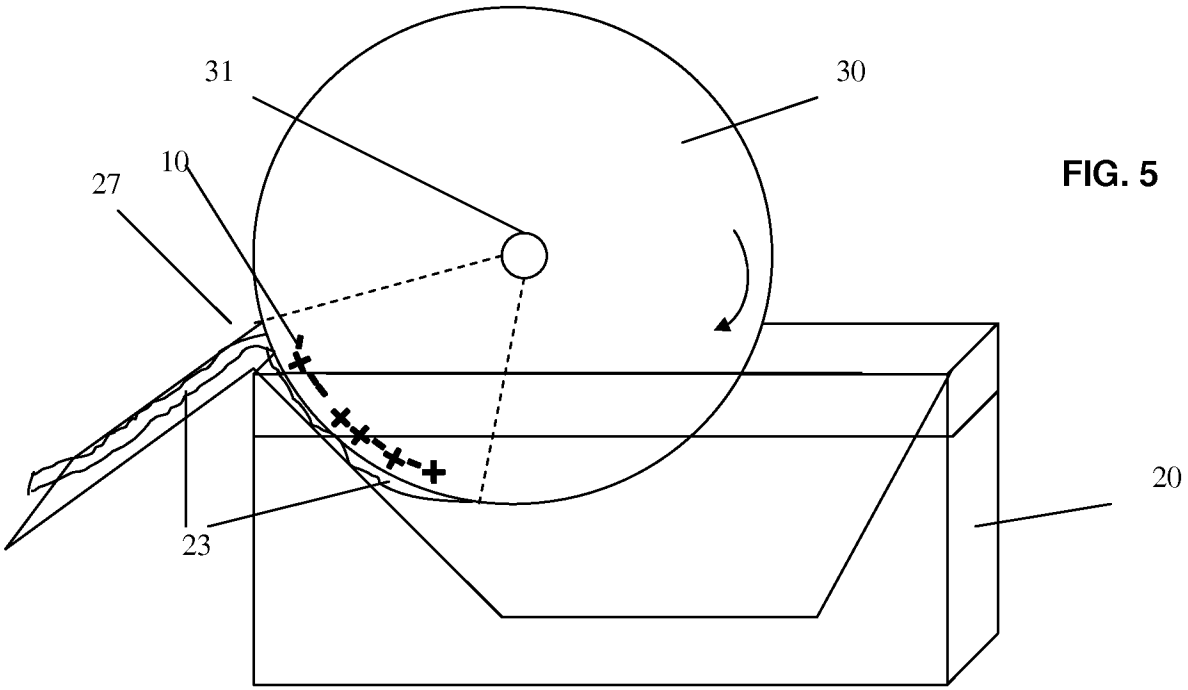
FIG. 5 is a diagram of a magnetic separation system that transports material mix through a magnetic filter that includes magnetic arrays, according to an embodiment of the present invention.

In other embodiments, magnetic separation systems may employ other mechanisms to transport material mix through a magnetic filter that includes magnetic arrays. Referring to FIG. 5, for example, a magnetic separation system may include a drum 30 with magnetic arrays 10 located on the circumferential surface of the drum, or on a fixed axis or shaft 31 on which the drum 30 rotates. The drum 30 may rotate immersed in or in contact with a material mix 20 and may separate magnetic particles 23 from the material mix 20. In this embodiment, the magnetic particles 23 may be attracted to the drum 30, and the drum's rotation may push the magnetic particles 23 towards drop-off point 27, where the magnetic material 23 is separated from drum 30. Other mechanisms may be used that allow the material mix to be transported through a magnetic filter using magnetic arrays and magnetic material to be separated from the material mix.

Figure 6:
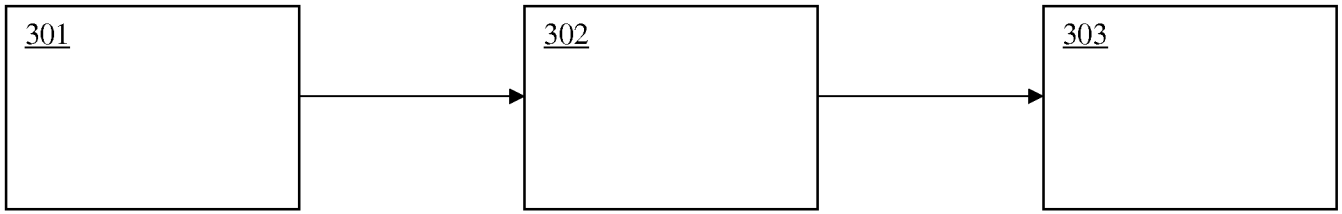
FIG. 6 is a flowchart of a method for a magnetic separation according to one embodiment of the present invention.

FIG. 6 is a flowchart of a method for a magnetic separation. The magnetic separation system may include at least one pulley system to transport a stream of material mix through a magnetic filter, e.g., through a spatially modulated magnetic field. In operation 301, one or more spatially modulated magnetic fields are applied to a stream of material mix. The spatially modulated magnetic field may be generated by magnetic arrays. In one embodiment, the spatially modulated magnetic field may be fixed onto a structure and directed towards the stream of material mix. As the material mix is transported through the spatially modulated magnetic field, the field may exert constant strength or magnitude onto the stream of material mix that passes within the field's vicinity, and thus attracting a constant amount of magnetic particles in its vicinity. In another embodiment, the spatially modulated magnetic field may vary in strength as the stream of material mix is transported through the field. The strength variation may change through time (as the position of the magnetized or unmagnetized regions changes relative to the material mix) and may exert a field of different strength on the material mix at different points in the stream. The spatially modulated magnetic field may cause magnetic particles to become attracted to the magnetic arrays' near vicinity. The magnetic particles attracted to the magnetic arrays are then separated from the stream of material mix in operation 302 for example through gravitational forces pulling on the rest of the material mix. In operation 303 the rest of the material mix may be output, for example, onto a conveyor system that receives a stream of filtered material mix. If the spatially modulated magnetic field in operation 301 is at a constant strength, the filtered material may have a uniform distribution of magnetic particles. If the spatially modulated magnetic field in operation 301 is time-varying, the filtered material may have a spatially varying distribution of magnetic particles.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

What is claimed is:

1. A magnetic separation device comprising:

a fixed wheel having a plurality of permanent magnetic arrays, each array including at least two rows of a plurality of successive positive and negative magnetic regions magnetized into the fixed wheel, wherein at least two of the magnetic regions have different magnetic strengths; and a conveyance mechanism configured to cause the mixture of magnetic and non-magnetic materials to be disposed within magnetic fields of the arrays.

2. The magnetic separation device of claim 1, wherein the conveyance mechanism includes a conveyer belt.

* * * * *